US006619095B2

(12) United States Patent
Matsuoka

(10) Patent No.: US 6,619,095 B2
(45) Date of Patent: Sep. 16, 2003

(54) PRESS APPARATUS

(75) Inventor: Mitsuo Matsuoka, Hirakata (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/901,625

(22) Filed: Jul. 11, 2001

(65) Prior Publication Data

US 2002/0152789 A1 Oct. 24, 2002

(30) Foreign Application Priority Data

Apr. 18, 2001 (JP) ..... 2001-118961

(51) Int. Cl.[7] ..... B21D 5/01
(52) U.S. Cl. ..... 72/315; 72/452.9
(58) Field of Search ..... 72/313–315, 452.9, 72/386, 297; 83/588

(56) References Cited

U.S. PATENT DOCUMENTS

| | | | | |
|---|---|---|---|---|
| 5,931,074 A | * | 8/1999 | Matsuoka | 83/588 |
| 6,006,576 A | * | 12/1999 | Genseberger et al. | 72/315 |
| 6,230,536 B1 | * | 5/2001 | Matsuoka | 72/313 |
| 6,336,399 B1 | * | 1/2002 | Matsuoka | 72/452.9 |

FOREIGN PATENT DOCUMENTS

| | | | |
|---|---|---|---|
| JP | 56-165524 | * | 12/1981 |
| JP | 11-147143 | * | 6/1999 |
| JP | 2001-1046 | * | 1/2001 |
| JP | 2001-47156 | * | 2/2001 |

* cited by examiner

*Primary Examiner*—Daniel C. Crane
(74) *Attorney, Agent, or Firm*—Birch, Stewart, Kolasch & Birch, LLP

(57) ABSTRACT

A pressing apparatus provides an urging force for a slide cam to press only when necessary, and elsewhere this pressing-force is maintained as small as possible. Abnormal wear and seizure of the slide cam, slide cam base and the sliding portion of the driven cam are prevented. The pressing apparatus can also provide a larger retracting force for the slide cam near a lower dead center of a pressing stroke. The present apparatus includes a slide cam slidably provided in a guidepost attached to the slide cam base and guided by the slide cam base, a pressing member held by the slide cam, a retracting-spring between the slide cam base and the slide cam for urging the slide cam, and a driven cam for contacting and driving the slide cam. A pressing-spring for urging the slide cam only near a lower dead center of a pressing stroke is provided between the slide cam base and the slide cam and/or between the slide cam and the driven cam.

20 Claims, 8 Drawing Sheets

SPRING DIAGRAM.

COIL SPRING n=6
GAS SPRING n=3

PRESS APPARATUS

This nonprovisional application claims priority under 35 U.S.C. §119(a) on Patent Application No. 2001-118961 filed in Japan on Apr. 18, 2001, which is herein incorporated by reference.

BACKGROUND OF THE INVENTION

SUMMARY OF THE INVENTION

The present invention relates to a pressing apparatus, and particularly to a pressing apparatus exerting a pressing force only near the lower dead center of the pressing stroke where the pressing force is mostly needed.

When bending a work by means of a cam die for example, assume that there is an 85 mm pressing stroke. Within this 85 mm of the pressing stroke, it is only about 25 mm portion near the end of the pressing stroke, i.e. near the lower dead center of the pressing apparatus, that is used directly for bending the work. It is this ending portion of the pressing stroke that requires a large pressing force for bending operation for example.

The slide cam is urged by a pressing-urge provider, which is generally provided by a coil spring. In order to exert a large urging force near the ending portion of the pressing stroke, an initial spring pressure must also be set at a high level of spring pressure.

Because of this setting, the slide cam, a slide cam base and a sliding portion of a driven cam are subject to abnormal wear and seizure.

Another problem is that during a preparatory step before manufacture, a few design changes are usually made to the pressing apparatus. In such occasions for example, it is required that the slide cam, the slide cam base, the driven cam and so on should be disassembled and reassembled easily, with the pressing apparatus staying installed to the pressing machine.

With the circumstances described above, it is an object of the present invention that the urging force for the slide cam to press is provided only when necessary and this pressing-urge is held as small as possible in a portion of the pressing stroke in which the work is not directly pressed, thereby preventing abnormal wear and seizure of the slide cam, slide cam base and the sliding portion of the driven cam. The present invention provides a pressing apparatus comprising: a slide cam base; a slide cam slidably provided in a guide-post attached to the slide cam base, the slide cam holding a pressing member such as a bending member and being guided by the slide cam base; a retracting-urge provider provided between the slide bas base and the slide cam for urging the slide cam; and a driven cam for contacting and driving the slide cam; wherein a pressing-urge provider for urging the slide cam only near a lower dead center of a pressing stroke is provided between the slide cam base and the slide cam and/or between the slide cam and the driven cam.

Further, in order to enable disassembling and reassembling of the slide cam, the slide cam base and the driven cam with the pressing apparatus staying installed to a pressing machine, the present invention provides a pressing apparatus, wherein the guidepost has an end formed with a threaded hole and each of the retracting-urge provider and the pressing-urge provider are mounted on a mounting plug faced by a wall formed with a through hole, thereby enabling the disassembling and reassembling of the slide cam, with the pressing apparatus remaining installed to the pressing machine.

PROBLEMS TO BE SOLVED BY THE INVENTION

Now, the present invention will be described based on a specific embodiment shown in the accompanying drawings.

Figure 1:
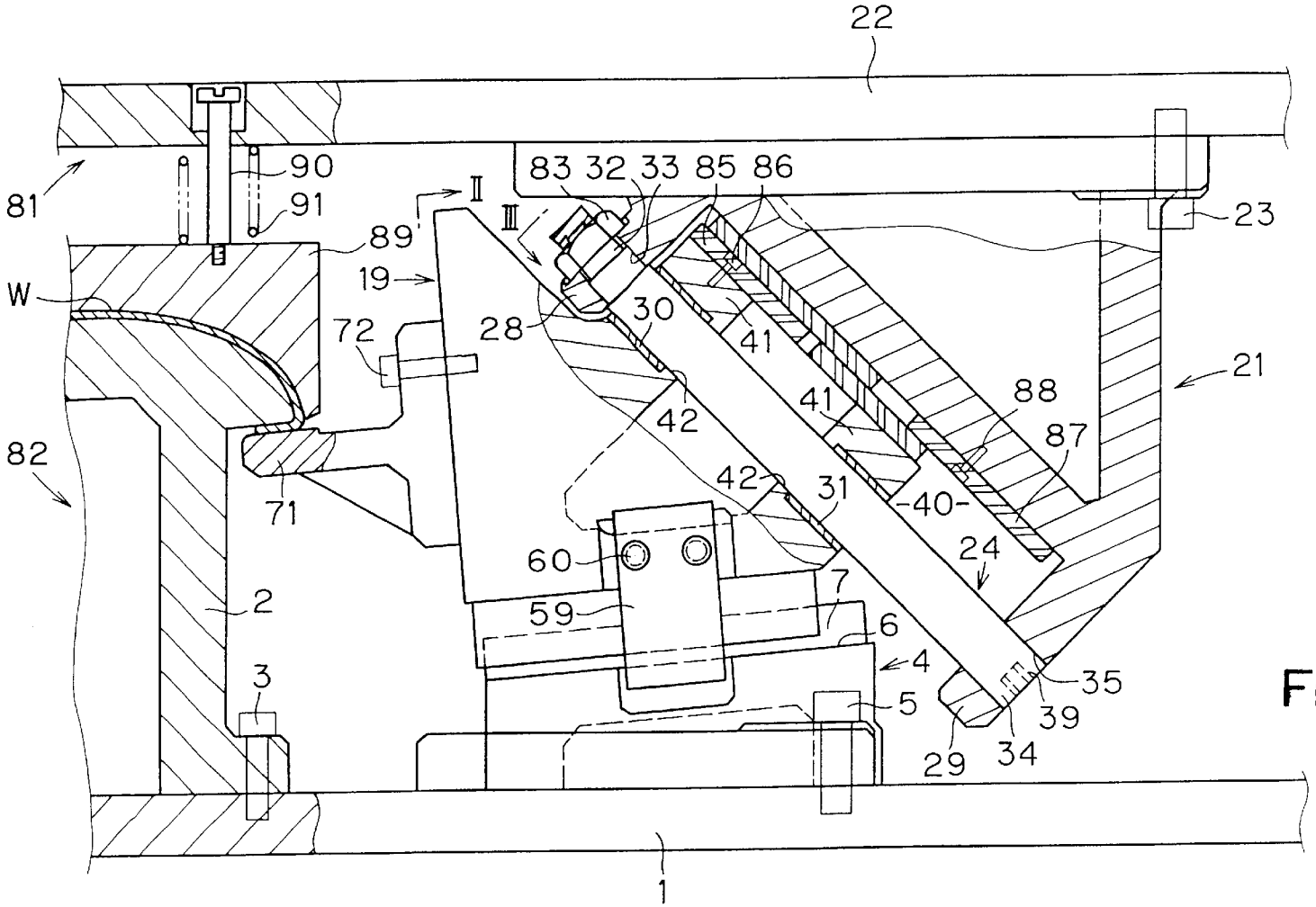
FIG. 1 shows a pressing apparatus as an embodiment of the present invention, showing a section at a lower dead center.
Figure 2:
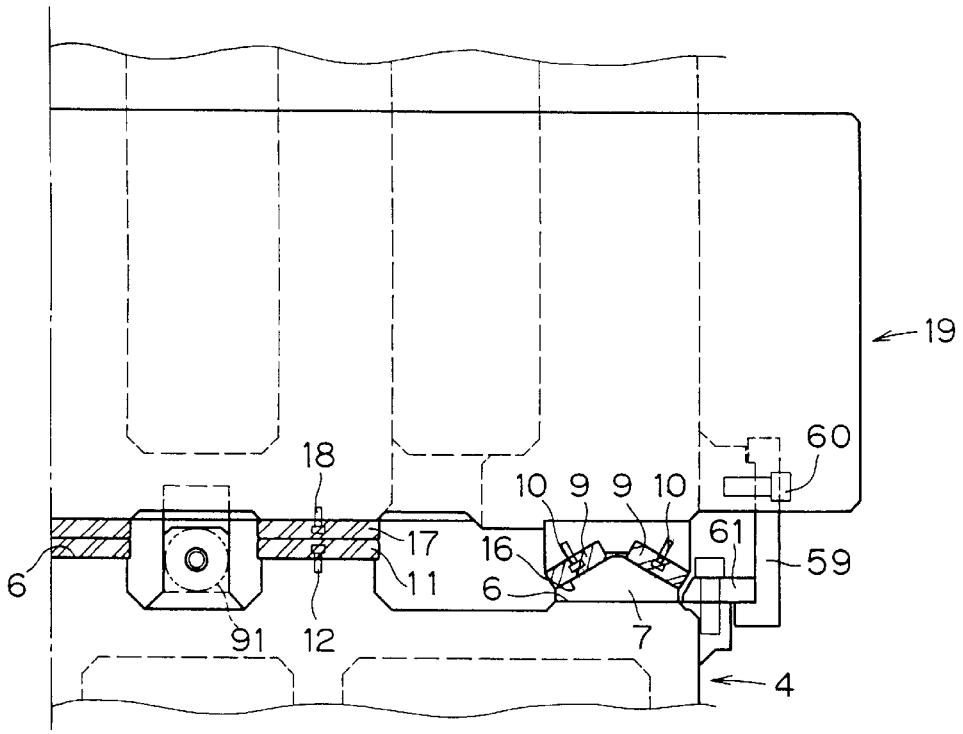
FIG. 2 is a view taken from a direction indicated by Arrow II in FIG. 1.
Figure 3:
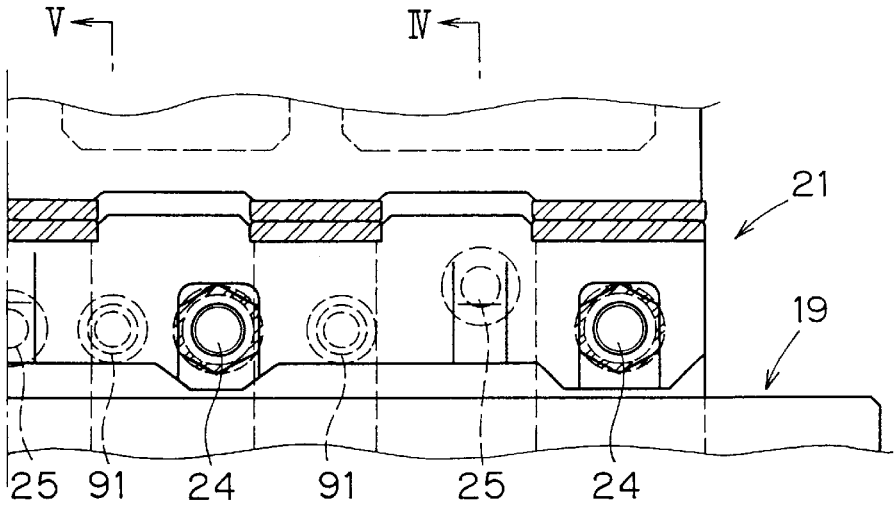
FIG. 3 is a view taken from a direction indicated by Arrow III in FIG. 1.
Figure 4:
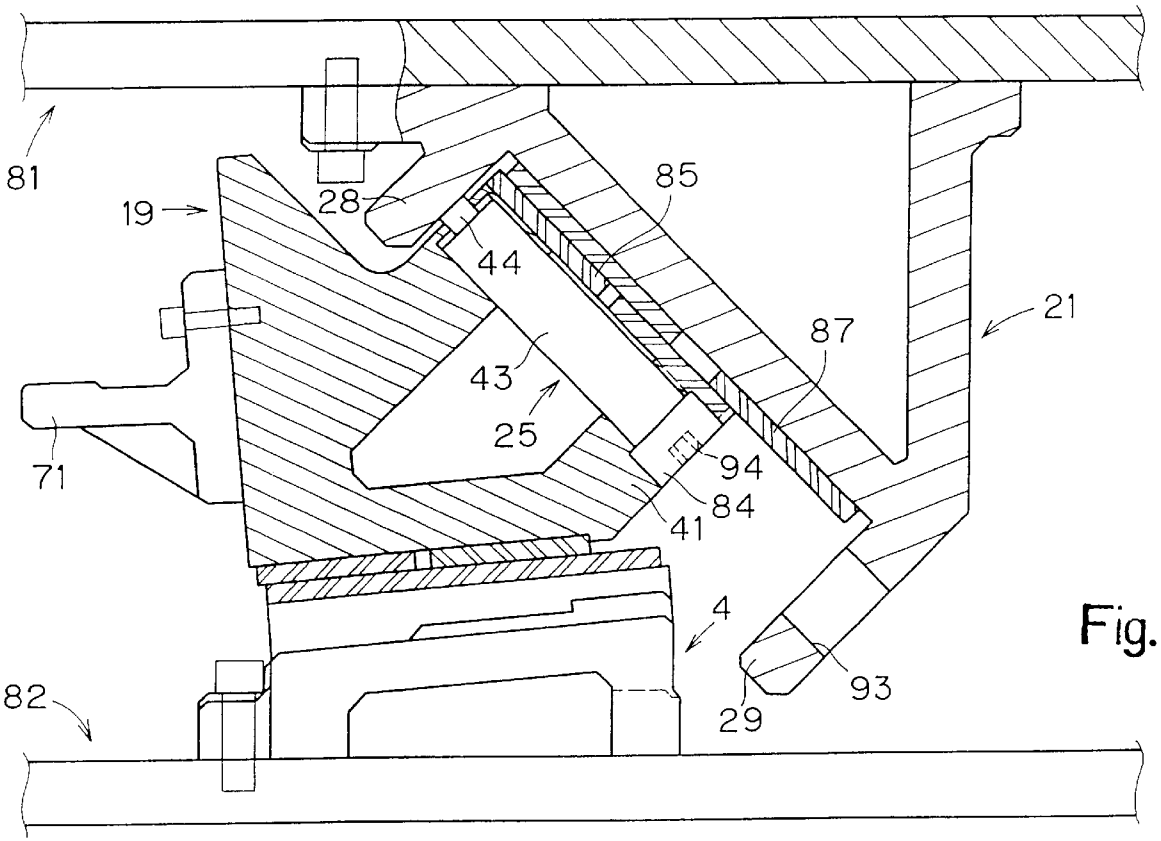
FIG. 4 is a sectional view taken from a direction indicated by Arrow IV in FIG. 3.
Figure 5:
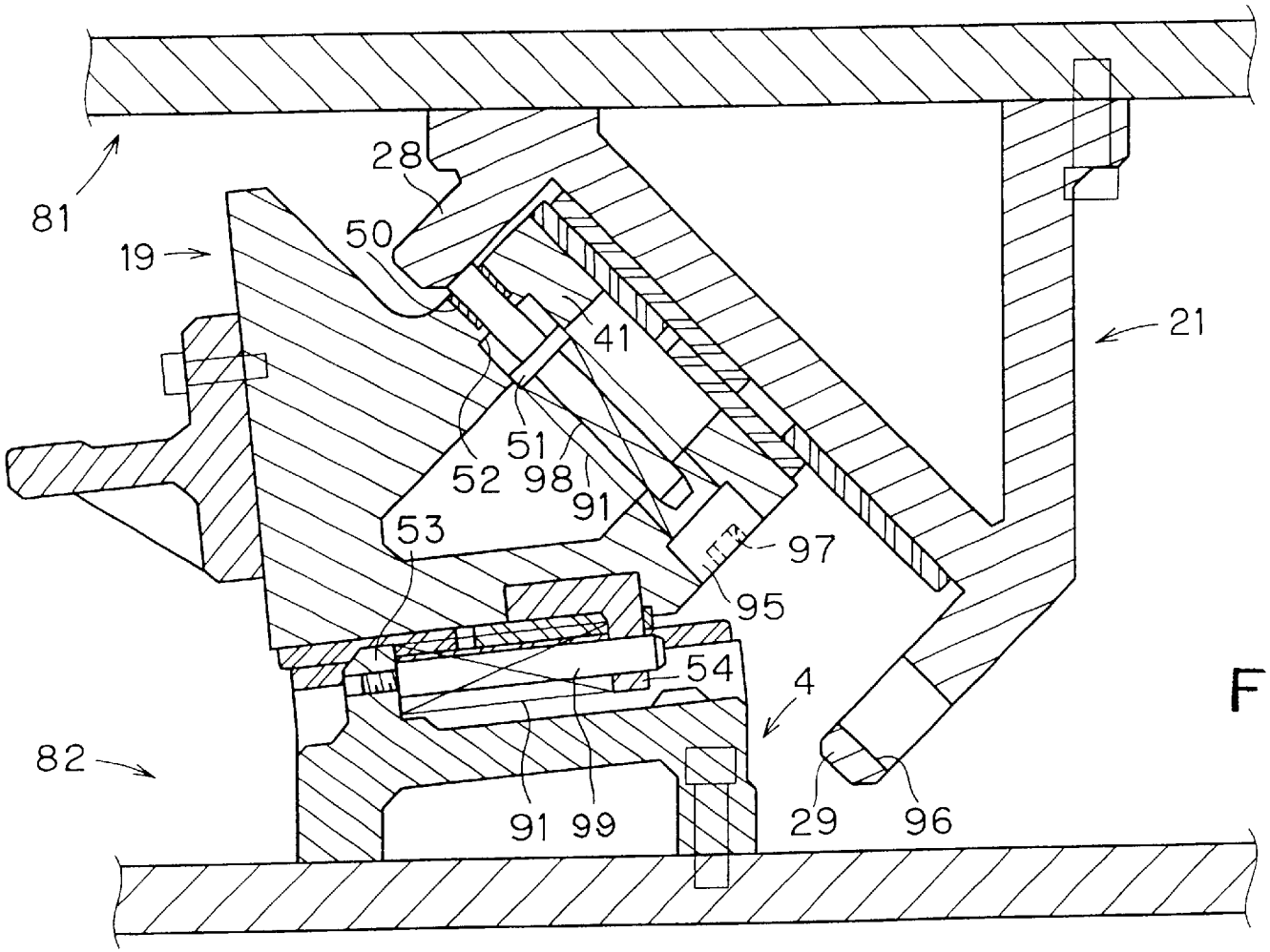
FIG. 5 is a sectional view taken from a direction indicated by Arrow V in FIG. 3.
Figure 6:
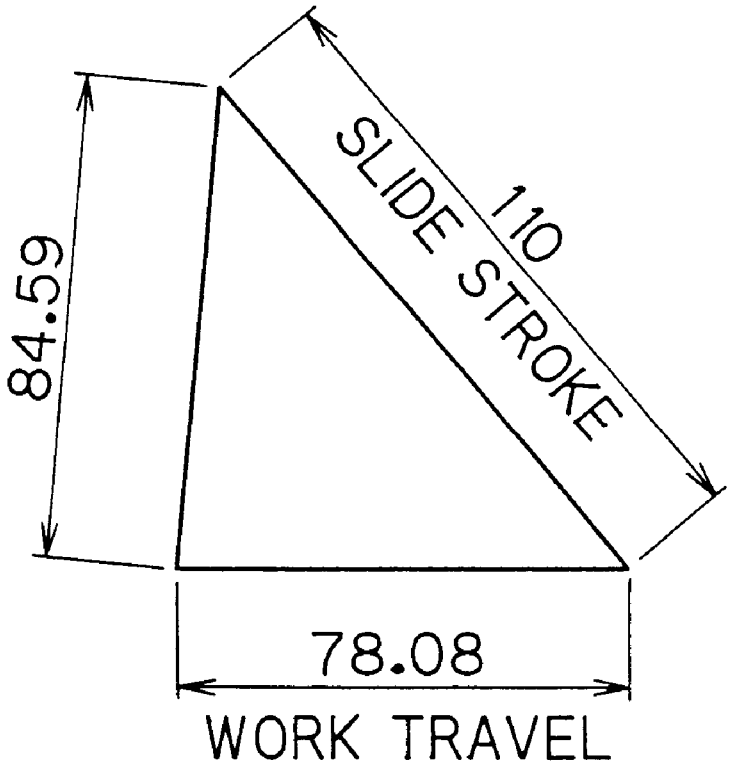
FIG. 6 is a stroke diagram according to the embodiment of the present invention.
Figure 7:
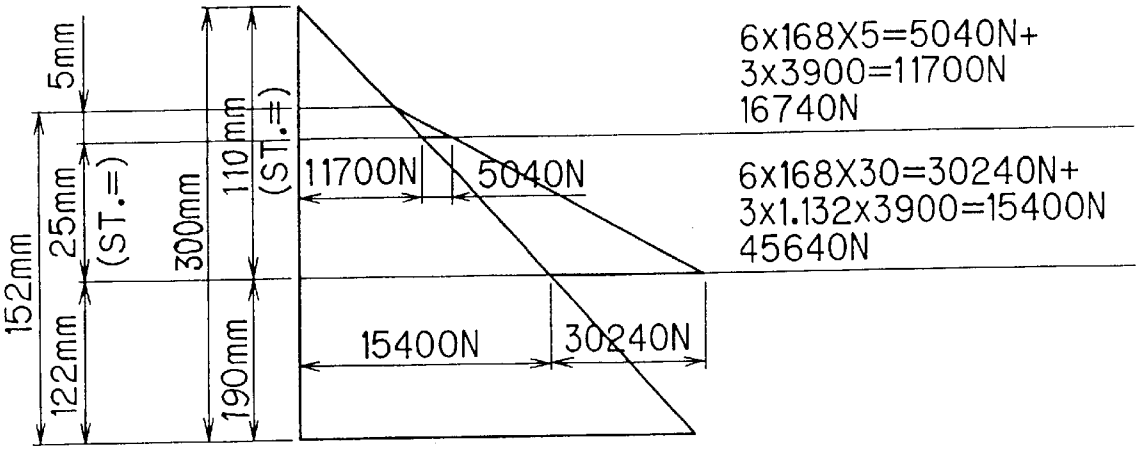
FIG. 7 is a diagram of a spring (retracting-urge provider, pressing-urge provider) according to the embodiment of the present invention.
Figure 8:
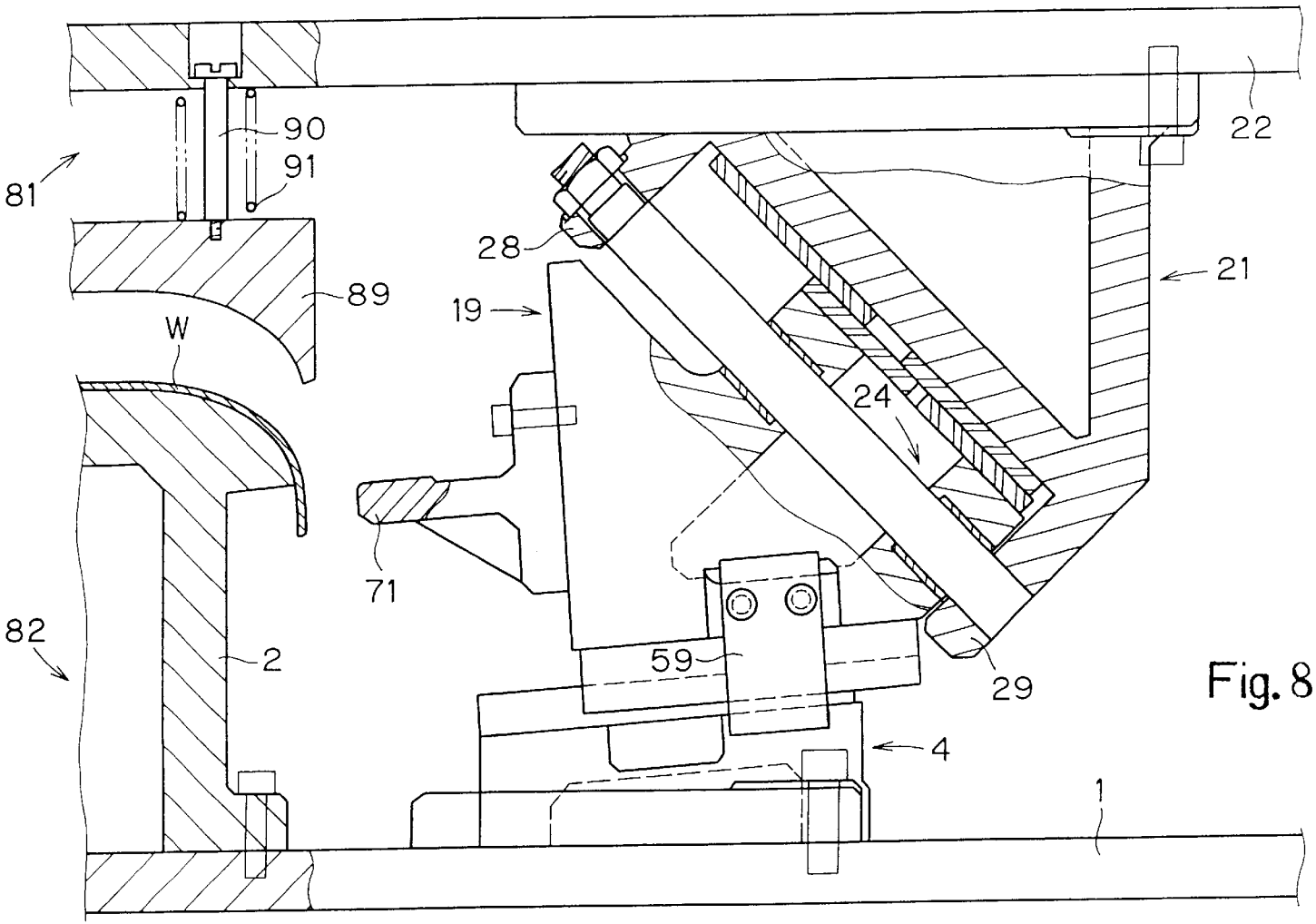
FIG. 8 shows the pressing apparatus as an embodiment of the present invention, showing a section at an upper dead center.

FIG. 1 shows a cam-operated pressing apparatus as an embodiment of the present invention, showing a section at a lower dead center. FIG. 2 is a view taken from a direction indicated by Arrow II in FIG. 1. FIG. 3 is a view taken from a direction indicated by Arrow III in FIG. 1. FIG. 4 is a sectional view taken from a direction indicated by Arrow IV in FIG. 3, showing a retracting-urge provider portion at the lower dead center. FIG. 5 is a sectional view taken from a direction indicated by Arrow V in FIG. 3, showing a pressing-urge provider portion. FIG. 6 is a stroke diagram. FIG. 7 is a diagram of a spring (retracting-urge provider, pressing-urge provider). FIG. 8 shows a section at an upper dead center.

The present embodiment is a pressing apparatus for bending a work.

As shown in FIG. 1, a lower die 82 has a lower base plate 1 provided with a supporting member 2 fixed by a bolt 3 for positioning a work W.

Near the supporting member 2 and on the lower base plate 1, a driven cam 4 having an upper surface slanted to become lower toward the supporting member 2, i.e. having a rightward rising slope as viewed in the figure, is fixed by a bolt 5. The slanted surface 6 of the driven cam 4 is provided with a ridge-shaped guide 7.

As shown in FIG. 2, the ridge-shaped guide 7 has an upper surface provided with a wear plate 9 fixed by a bolt 10. Further, the slanted surface 6 of the driven cam 4 is provided with a wear plate 11 fixed by a bolt 12.

As shown in FIG. 2, a slide cam 19 is generally wedge-shaped, having a lower surface provided with a V groove 16 and a wear plate 17 fixed by a bolt 18. The V groove is provided with a wear plate 9 contacted with the driven cam 4. The wear plate 17 is contacted with the wear plate 11 of the driven cam 4. With this arrangement, the slide cam 19 is slidably mounted on the driven cam 4.

On the other hand, a slide cam base 21 has a surface oppositely slanted to the driven cam 4, or more specifically has a rightward falling slope as viewed in the figure, and is fixed to an upper base plate 22 of an upper die 81 by a bolt 23. The slide cam base 21 has a lower end portion provided with rightward falling guideposts 24, to which the slide cam 19 is slidably installed. Further, the slide cam 19 is urged by a gas spring 25 which serves as a retracting-urge provider, built in the slide cam base 21 in a rightward falling direction as viewed in FIG. 4.

As shown in FIG. 1, the guideposts 24 are installed on two walls 28, 29 of the slide cam base 21. The guideposts 24 are each fitted into bores 42 provided in a guidepost support 41 in an upper portion of the slide cam 19, via bushings 30, 31 coaxially fitted into respective bores. Each of the guidepost 24 has a diametrically smaller end portion 32 inserted into a fitting bore 33 of the wall 28. The tip of the diametrically smaller end 32 is threaded by a nut 83, while the other end portion 34 is fitted into a fitting bore 35 of the wall 29.

A circular circumference and circular bore can be machined highly accurately as compared with prismatic or other shape because of the circular nature. For this reason, according to the present invention, the guidepost 24 is made to have a circular section, and the bushings 30, 31 and the fitting hole 33 are shaped into circular holes, so that machining can be performed highly accurately. Further, since the guidepost 24 having a circular circumferential surface is in a tight-fit relationship with circular bores of the bushings 30, 31, a highly accurate radial fitting with respect to a central axis can be maintained over the entire 360-degree circumference.

It should be noted here that the guidepost may be solid or hollow as far as having a circular section. However, in consideration of strength, a solid guidepost is preferable.

Sometimes, the slide cam 19 must be removed from the slide cam base 21 for a purpose of maintaining the slide cam 19, the driven cam 4, the slide cam base 21 and so on. In such an occasion as this, there is no need for removing many bolts as in the prior art. Instead, by simply removing the nut 83 from the end of the diametrically smaller end 32, the guidepost 24 can be easily pulled out. If a bolt is threaded into a bolt hole 39 provided in said other end portion 34 of the guidepost 24, the guidepost 24 can be pulled out even more easily by using the threaded bolt.

The slide cam 19 is provided in the slide cam base 21, via the guideposts 24 and the gas springs 25.

According to the embodiment in FIG. 3, the lower portion of the slide cam base 21 is provided with four of the guideposts 24, with the space in between serving as guide grooves 40. The slide cam 19 has an upper portion provided with the rightward rising guideposts supports 41. The guidepost supports 41 are movable within the guide grooves 40. The guidepost supports 41 are formed with the rightward falling insertion bores 42. These insertion bores 42 are fitted by coaxial bushings 30, 31, and the guideposts 24 are fitted into these bushings 30, 31.

As shown in FIG. 4, the gas spring 25 is disposed on a slant, with rightward end lower, and a rod 44 contacted with the wall 28. The rod 44, which provides the gas spring 25 together with a cylinder 43, can extend and retract. The gas spring 25 has a base end contacted with a mounting plug 84 threaded to the guidepost support 41 formed at a lower region of an upper portion of the slide cam 19. The guidepost support 41 of the slide cam 19 has an upper surface provided with a wear plate 87 fixed by a bolt 88. The wear plate 85 and the wear plate 87 contact and slide each other.

The slide cam 19 is generally wedge-shaped, sandwiched by the driven cam 4 and the slide cam base 21, and pushed to move toward the work W placed on the supporting member 2, to press the work W. FIG. 1 shows a state in which the pressing apparatus is at its lower dead center. The slide cam 19 approaches the supporting member 2, and the figure shows the slide cam at a left end of its stroke, with rod 44 of the gas spring 25 in its fully retracted state. When the slide cam 19 is freed of the bind from the driven cam 4 and the slide cam base 21, the slide cam 19 comes under an urge from the gas spring 25, and the rod 44 begins to extend. The rod 44 is fully extended at the upper dead center, i.e. the state shown in FIG. 8. (The fully extended rod 44 is not illustrated.)

The cylinder 43 of the gas spring 25 is charged with a gas of a high pressure, at 150 kgf/cm$^2$ for example, matched to an application, and provides a generally constant output of 150 kgf/cm$^2$ for example, over an entire stroke of the rod 44 regardless of the position of the rod 44 extending out of or retracting into the cylinder 43. This is made possible by two tanks incorporated in the cylinder 43: When the rod 44 is retracted to pressurize one of the tanks, the high pressure gas in this tank flows out into the other tank, thereby maintaining a generally constant output over the entire stroke of the rod (though the output may become slightly larger under compression).

As has been described, differing from a coil spring, the gas spring 25 can provide a high output over its entire stroke, making possible to reliably retract the slide cam 19 and being safe.

Further, the gas spring 25 can move the slide cam 19 for a long distance, making possible to press a big work of sheet metal into such a product as automobile side panel.

The slide base 21 and the slide cam 19 have sliding surfaces provided with wear plates 87, 85 respectively. The wear plate 87 is fixed by a bolt 88 to the slide cam base 21, whereas the wear plate 85 is fixed by a bolt 86 to the slide cam 19.

According to a prior art pressing apparatus equipped with the slide cam of this kind, the surface pressure used is 50 to 60 kgf/cm$^2$, and only one of the slide cam base and the slide cam is provided with a wear plate. According to the present invention, each of the slide cam base and the slide cam is provided with a wear plate and only worn-out wear plates may be replaced, so that the pressing apparatus can be used on a large pressing machine capable of exerting the surface pressure of up to 150 kgf/cm$^2$.

Further, according to the prior art pressing apparatus equipped with the slide cam of this kind, even if the size of the pressing apparatus is increased to have the slide cam having a larger width (left-right directions in FIG. 3), support is provided only by guide plates on the two sides. Therefore, the slide cam is in a deflected state. According to the present invention, the deflection is eliminated by providing guideposts at appropriate locations (four locations according to the embodiment in FIG. 3).

The present embodiment is being described as an apparatus for bending operation.

As shown in FIG. 1, a bending member 71 is fixed by a bolt 72 to the slide cam 19, at a location facing the supporting member 2 which supports the work W.

On the other hand, FIG. 8 shows the pressing apparatus at its upper dead center.

Next, an operation of this pressing apparatus will be described.

As shown in FIG. 8, the work W is placed on the supporting member 2, and then the upper die 81 is lowered. The state shown in FIG. 8 is when the pressing apparatus is at its upper dead center, where the slide cam 19 is slidably provided in the guidepost 24 of the slide cam base 21 which is attached to the upper base plate 22 of the upper die 81, and the slide cam 19 is under an urge from the gas spring 25 and is contacted with the wall 29.

From this state, when the upper die 81 is lowered, the wear plate 17 of the slide cam 19 and the wear plate 9 of the V groove 16 make contact with the wear plate 11 and the ridge-shaped guide 7 of the driven cam 4. When the upper die 81 continues to lower, the slide cam 19 sandwiched by the driven cam 4 and the slide cam base 21 presses the work W with a pad 89. The slide cam 19 moves forward to the work W, and the work W is bent by the supporting member 2 and the bending member 71. It should be noted that the members indicated by numerals 90 and 91 are a suspending bolt and a coil spring respectively.

Thus, the bending is made by the bending member 71, and the pressing apparatus comes to the lower dead center, i.e. the state shown in FIG. 1.

FIG. 6 is a stroke diagram of the present bending operation. A vertical pressing stroke of this pressing apparatus is 84.59 mm. A travel distance of the slide cam 19 on the guidepost 24 is 110 mm, and a travel distance of the slide cam 19 on the driven cam 4 is 78.08 mm.

As shown in FIG. 2 and FIG. 3, the slide cam 19 is hung by the four guideposts 24, and use is made of three gas springs serving as retracting-urge providers and a total of six coil springs 91 serving as pressing-urge providers.

The state of the slide cam 19 hung by the guideposts 24 is illustrated in FIG. 1 and FIG. 8.

The state of the slide cam 19 urged by the gas spring 25 is illustrated in FIG. 4. FIG. 4 shows the pressing apparatus at its lower dead center, in which the rod 44 of the gas spring 25 is fully retracted. When the bending operation is complete and the upper die 81 is raised, the urge from the gas spring 25 moves the slide cam 19 into contact with the wall 29 of the slide cam base 21, to a state in which the rods 44 are fully extended.

The gas springs 25 are each contacted with the mounting plug 84. In order to allow disassembling and reassembling of the slide cam 19 and other members without detaching the pressing apparatus from the pressing machine, a through hole 93 is provided in the wall 29 facing each of the mounting plugs 84, whereas a hexagonal hole 94 is provided in the outward surface of each mounting plug 84 as a receptacle for a wrench.

The state in which the slide cam 19 is under the urge from the coil spring 91 is shown in FIG. 5. In FIG. 5, the pressing apparatus is at its lower dead center, at which the coil spring 91 is fully compressed. Again, in order to allow disassembling and reassembling of the slide cam 19 and other members without detaching the pressing apparatus from the pressing machine, a through hole 96 is provided in the wall 29 facing each of the mounting plugs 95, whereas a hexagonal hole 97 is provided in the outward surface of each mounting plug 95 as a receptacle for a wrench.

The coil spring 91 contacting the mounting plug 95 is attached around the positioning pin 98. The positioning pin 98 is slidably inserted into a bushing 50 press-fitted to the guidepost support 41 of the slide cam 19. The positioning pin 98 has an upper end surface contacted with the wall 28 of the slide cam base 21. The coil spring 91 has an end contacted with the mounting plug 95, and the other end contacted with a flange 51 provided at an intermediate portion of the positioning pin 98. The coil spring 91 is fully compressed in the figure, exerting the greatest spring pressure. When the upper die 81 is lowered, the slide cam 19 sandwiched between the driven cam 4 and the slide cam base 21 is slid leftward as viewed in FIG. 5. The coil spring 91 initially is fully extended, with the flange 51 of the positioning pin 98 contacted with a bore bottom 52, and its spring pressure is small. However, the spring pressure becomes large near the lower dead center of the pressing stroke. A setting is made in such a way that a large pressing force necessary for bending operation near the ending portion of the pressing stroke is exerted. It should be noted here that when the coil spring 91 is compressed, its spring force acts rightward as in the figure, and the reaction thereof slides the slide cam 19 leftward.

Another coil spring 91 is provided between the slide cam 19 and the driven can 4. In this case, a positioning pin 99 is threaded into an upright wall 53 in an upper surface of the driven cam 4. The coil spring 91 is attached around this pin, which penetrates an L-shaped pressure receiving member 54 fixed to a lower surface of the slide cam 19. The coil spring 91 is compressed between the wall 53 and the pressure receiving member 54, and its spring pressure is set in such a way that a large pressing force necessary for bending operation near the ending portion of the pressing stroke is exerted.

According to the present embodiment, four coil springs 91 are used between the slide cam 19 and the slide cam base 21, and two coil springs 91 are used between the slide cam 19 and the driven cam 4. However, depending on necessity, the coil spring may be used only between the slide cam and the slide cam base, or only between the slide cam and the driven cam.

The gas spring 25 and the coil spring 91 used in the present embodiment will be described by using a spring diagram shown in FIG. 7. The gas spring 25 used in the present embodiment has a main body of a length of 300 mm when fully extended, with an allowable stroke of 125 mm (This relationship is not shown in FIG. 7.) Of this stroke, a 110 mm stroke is utilized (This relationship is not shown in FIG. 7.), with the remaining 15 mm stroke is not used. (This relationship is not shown in FIG. 7.) The coil spring 91 has a total length of 152 mm. Of this length, 30 mm is used, and the remaining 122 mm is not used. Of the 30 mm, 5 mm is used for initial pressurizing and the remaining 25 mm stroke is used for an output to the bending operation.

When the coil spring 91 is compressed by 5 mm for the initial pressurizing, an output from the gas spring 25 is 11700 N (Newton: 1 kgf≈9.8 N). From here, at a point further down the stroke by 25 mm, an output from the gas spring 25 is 15400 N. The initial pressure from the coil spring 91 compressed by 5 mm is 5040 N. Thus, a total output combined with the 11700 N output from the gas spring 25 is 16740 N. On the other hand, when at the point further down the stroke by 25 mm, an output from the coil spring 91 is 30240 N. Thus, a total output combined with the 15400 N output from the gas spring 25 is 45640 N.

A total pressing stroke of this pressing apparatus is 84.59 mm as shown in FIG. 6. In this stroke, the output is increased from 16740 N to 45640 N in about 25 mm portion near the end of the pressing stroke. As exemplified, a large pressing force necessary for bending operation is outputted near the ending portion of the pressing stroke, thereby achieving a high quality bending.

Thereafter, when the upper die 81 is raised, the urge from the gas spring 25 is transmitted from the rod 44 to the slide cam 19. The slide cam 19 is then backed up, and is stopped by the wall 29. As described, the gas spring 25 can exert a large force to retract the slide cam 19 near the ending portion of the pressing stroke.

The slide cam 19 is provided with a return plate 59. Therefore, if the slide cam 19 is not retracted for some reason, the return plate 59 engages with the driven cam 4, thereby forcing the slide cam 19 to retract.

In the present embodiment a bending operation is described. However, the present invention is also applicable to other forming operation.

Further, the slide cam base 21, the slide cam 19 and the driven can 4 may be standardized so that the pressing apparatus can be readily adapted to the work of a variety of sizes.

It should be noted here that the above description covers a case in which the slide cam base 21 is provided in the upper die 81 and the driven cam 4 is provided in the lower die 82. However, the slide cam base 21 may be provided in the lower die 82 and the driven cam 4 may be provided in the upper die 81. This case may sometimes be regarded as safer for the operation, because the slide cam 19 is not hung by the upper die 81 but is mounted on the lower die 82.

The present invention encompasses not only the case in which the slide cam 19 is in the upper die 81 but also the case in which the slide cam 19 is disposed in the lower die 82.

As described above, according to the present invention, there is provided a pressing apparatus comprising: a slide cam base; a slide cam slidably provided in a guidepost attached to the slide cam base, the slide cam holding a pressing member such as a bending member and being guided by the slide cam base; a retracting-urge provider provided between the slide bas base and the slide cam for urging the slide cam; and a driven cam for contacting and driving the slide cam; wherein a pressing-urge provider for urging the slide cam only near a lower dead center of a pressing stroke is provided between the slide cam base and the slide cam and/or between the slide cam and the driven cam. Therefore, an urging force for the slide cam to press is provided only when necessary, and elsewhere this pressing-urge is held as small as possible, whereby abnormal wear and seizure of the slide cam, slide cam base and the sliding portion of the driven cam are prevented. Further, the present invention enables to provide a large retracting force for the slide cam near a lower dead center of a pressing stroke.

The setting of the cam according to the pressing apparatus provided by the present invention also clears an interference problem in a transfer pressing. Further, the present invention provides a pressing apparatus, wherein the guidepost has an end formed with a threaded hole and each of the retracting-urge provider and the pressing-urge provider are mounted on a mounting plug faced by a wall formed with a through hole, thereby enabling the disassembling and assembling of the slide cam, with the pressing apparatus remaining installed to the pressing machine. Therefore, the urging force for the slide cam to press is provided only when necessary and elsewhere this pressing-urge is held as small as possible, whereby abnormal wear and seizure of the slide cam, slide cam base and the sliding portion of the driven cam are prevented.

What is claimed is:

1. A pressing apparatus comprising:

an upper base plate and a lower base plate;

a lower die being provided on said lower base plate;

an upper die being provided on said upper base plate, said upper die having an upper dead center and a lower dead center;

a slide cam base operatively connected to said upper base plate;

a slide cam operatively connected to said slide cam base, wherein said slide cam is slidably provided in a guidepost attached to the slide cam base and said slide cam is guided along an operating path by said slide cam base;

a pressing member, wherein the pressing member is held by the slide cam and a contact position of said pressing member coincides with said lower dead center of said upper die;

at least one retracting-spring being provided between the slide cam base and the slide cam for providing a spring force for moving the slide cam along said operating path; and a driven cam being provided on said lower base plate, said drive cam contacting and driving the slide cam along the operating path;

at least one pressure-spring providing a spring force for moving the slide cam along said operating path toward the contact position of said pressing member in a pressing stroke.

2. The pressing apparatus according to claim 1, wherein said at least one pressure spring includes a pressure spring provided between said slide cam base and said slide cam.

3. The pressing apparatus according to claim 1, wherein said at least one pressure spring includes a pressure spring provided between said driven cam and said slide cam.

4. The pressing apparatus according to claim 2, wherein said at least one pressure spring includes a pressure spring provided between said driven cam and said slide cam.

5. The pressing apparatus according to claim 1, wherein said guidepost further includes a first end formed with a threaded hole;

a wall having a through hole; and a mounting plug, wherein at least one of said retracting-spring and said pressure-spring are mounted to said guidepost within said through hole and operatively secured by said mounting plug.

6. The pressing apparatus according to claim 4, wherein said guidepost further includes a first end formed with a threaded hole;

a wall having a through hole; and a mounting plug, wherein at least one of said retracting-spring and said pressure-spring are mounted to said guidepost within said through hole and operatively secured by said mounting plug.

7. The pressing apparatus according to claim 1, wherein said pressing member provides a bending force in said contact position.

8. The pressing apparatus according to claim 1, wherein the lower die is operatively secured to said lower base plate by a supporting member and bolt.

9. The pressing apparatus according to claim 1, wherein the upper die is operatively secured to said upper base plate by a bolt and an upper base plate pressure-spring.

10. The pressing apparatus according to claim 8, wherein said wherein the upper die is operatively secured to said upper base plate by a bolt and an upper base plate pressure-spring.

11. The pressing apparatus according to claim 1, wherein said slide cam base includes a slanted surface and a triangular cross-section and said slide cam has a slanted surface and a triangular cross-section, said guide post being attached to said slide cam base and said slide cam along said slanted surfaces.

12. The pressing apparatus according to claim 11, wherein said at least one retracting spring is operative between an extended position and a retracted position, said retracted position of said retracting spring coinciding with said lower dead center of said upper die.

13. The pressing apparatus according to claim 6, wherein said slide cam includes a slanted surface and a triangular cross-section and said slide cam has a slanted surface and a triangular cross-section, said guide post being attached to said slide cam base and said slide cam along said slanted surfaces.

14. The pressing apparatus according to claim 13, wherein said at least one retracting spring is operative between an extended position and a retracted position, said retracted position of said retracting spring coinciding with said lower dead center of said upper die.

15. The pressing apparatus according to claim 14, wherein said drive cam includes a slanted surface having a slope rising in a direction toward said slide cam base.

16. The pressing apparatus according to claim 15, wherein said slide cam and said driven cam each include a wear plate along said respective slanted surfaces.

17. The pressing apparatus according to claim 1, wherein said slide cam and said driven cam each include a wear plate along said operating path of said slide cam.

18. The pressing apparatus according to claim 1, wherein said slide cam and said slide cam base each include a wear plate along said operating path of said slide cam.

19. The pressing apparatus according to claim 1, wherein said slide cam includes a first wear plate operatively engaged with a wear plate of said slide cam base and a second wear plate operatively engaged with a wear plate of said driven cam along said operating path of said slide cam.

20. A pressing apparatus comprising:

an upper base plate and a lower base plate;

a lower die being provided on said lower base plate;

an upper die being provided on said upper base plate, said upper die having an upper dead center and a lower dead center;

a slide cam base operatively connected to said upper base plate;

a slide cam operatively connected to said slide cam base, wherein said slide cam is slidably provided along a circular-shaped guidepost attached to the slide cam base and said slide cam is guided along an operating path by said slide cam base;

a pressing member, wherein the pressing member is held by the slide cam and a contact position of said pressing member coincides with said lower dead center of said upper die;

at least one retracting-spring being provided between the slide cam base and the slide cam for providing a spring force for moving the slide cam along said operating path, wherein said at least one retracting-spring is a gas spring; and a driven cam being provided on said lower base plate, said drive cam contacting and driving the slide cam along the operating path;

at least one pressure-spring providing a spring force for moving the slide cam along said operating path toward the contact position of said pressing member in a pressing stroke, wherein said at least one retracting spring is a coil spring.

* * * * *